United States Patent [19]

Lee

[11] 4,155,132

[45] May 22, 1979

[54] RESCUE EQUIPMENT

[75] Inventor: William W. A. Lee, Bognor Regis, England

[73] Assignee: Mastep (Plastics) Ltd., Sussex, England

[21] Appl. No.: 823,399

[22] Filed: Aug. 9, 1977

[30] Foreign Application Priority Data

Sep. 28, 1976 [GB] United Kingdom ..... 40299/76

[51] Int. Cl.[2] ..... B63C 9/00

[52] U.S. Cl. ..... 9/14; 114/190; 224/42.46 R

[58] Field of Search ..... 9/8 R, 8 E, 9, 14; 114/190; 224/42.46 R; 221/295

[56] References Cited

U.S. PATENT DOCUMENTS

| | | | |
|---|---|---|---|
| 3,099,845 | 8/1963 | Chamberlain | 114/190 |
| 3,675,257 | 7/1972 | Haglund | 9/14 |
| 3,754,291 | 8/1973 | Harris | 114/190 |

*Primary Examiner*—Charles E. Frankfort
*Assistant Examiner*—D. W. Keen
*Attorney, Agent, or Firm*—Ostrolenk, Faber, Gerb & Soffen

[57] ABSTRACT

Rescue apparatus comprising a life belt, a housing support for said life belt, adapted to be mounted in a substantially erect manner, releasable retaining apparatus for retaining said life belt in juxtaposition to said housing support, and remote release apparatus whereby operation of the remote release apparatus releases the retaining apparatus to cause or allow the life belt to become detached from the housing support.

13 Claims, 4 Drawing Figures

RESCUE EQUIPMENT

The present invention relates to rescue equipment and has particular reference to rescue equipment providing a ready release of a lifebelt from a vessel.

In many yachts and small boats man-overboard rescue equipment comprises one or more horseshoe lifebelts or lifebuoy stored on deck in a housing, usually with an attached light float. In the event of man-overboard, once a man-overboard situation as been recognised, a crew member releases the lifebuoy and throws the same over the side of the boat. The period of delay involved can be a matter of two or three minutes and in an average cruising or racing yacht travelling at around six knots, the yacht has usually travelled some 3½ yds–5 yds per second before the life-saving equipment is dispatched overboard.

On a small yacht life-saving equipment serves two purposes. One is obviously to provide support means to the man in the water, but a more important purpose is to provide a marker for the relative position of the man in the water, and to this end it is necessary to dispatch two lifebuoys or lifebuoy and a marker buoy in the water at spaced intervals to provide a transit along which the boat can sail to return to the man in the water itself.

The paramount need on cruising yachts and yachts of the ocean racing fleet is, therefore, to provide means for jettisoning a lifebelt as soon after a man overboard situation arises as possible.

According to the present invention there is provided rescue apparatus comprising a lifebelt, a housing support for said lifebelt adapted to be mounted in a substantially erect manner, releasable retaining means for retaining said lifebelt in juxtaposition to said housing support and remote release means whereby operation of the remote release means releases the retaining means to cause or allow the lifebelt to become detached from the housing support.

For the purposes of this specification the term "lifebelt" is to be understood to include any floatable life support means such as a horseshoe lifebuoy, a circular lifebelt (the traditional variety) or a self-inflating support.

In accordance with the present invention, therefore, the operation of the remote release means releases the lifebelt which becomes detached from the housing support and falls into the water. It is preferred that the housing support for the lifebelt is disposed at or towards the aft end of the vessel so that the lifebelt is discharged from the housing support into the water in or about the wake of the boat.

It is preferred that a length of buoyant line is secured to the lifebelt and in accordance with one aspect of the invention, the housing is recessed to accommodate the lifebelt and the recess defines a central hub around which the buoyant line is wrapped so that on release of the belt the buoyant line unwraps progressively from said hub. The rescue equipment may also incorporate a second marker means such, for example, as a dan buoy retained in automatic release clips wherein the other end of said buoyant line is secured to said marker means so that on release of the lifebelt, from a moving vessel the buoyant line is withdrawn from its storage about the hub of the housing support until the extremity of the line is reached whereupon the drag of the apparatus in the water acts upon the dan buoy to release the dan buoy automatically from its mountings thereby providing a second marker in spaced relationship with the first giving a transit indication along which the vessel may return to the man in the water. The lifebelt preferably carries or is attached to a marker light which flashes on release of the belt from the housing support. Typical marker light floats are those commercially available under the trade names "McMurdo" or "Icarus". It is preferred that the buoyant line has a length of between 100 and 200 feet, ie: a length of line sufficient in the type of weather invisaged to leave a recongiseable transit time.

The retaining means preferably comprises one or more elastic retaining members extending from the periphery of the housing support to maintain the lifebelt in its stowed position and extending to a central removable spigot member supported by the housing support whereby removal of the spigot member releases the elastic retaining member to allow the lifebuoy to fall from the housing.

In a particular embodiment of the present invention, the release means comprises a central recess portion of the housing support, a bridge piece overlaying said recess portion, a drilling in said bridge portion and said recess portion, a release toggle including a length of simi-rigid bendable rod or plastic extrusion that extends through the drilling in the recess portion of the housing support and bridge piece, wherein the retaining means comprises one or more loops of bungy line extending from spaced locations at or towards the periphery of the housing support, the inner extremity of the loop being passed between the bridge piece and the recess whereby said inner extremity of the loop is secured by means of said toggle passing through the recess wall and the bridge piece through the drillings therein to retain the bungy across the housing support to retain the lifebelt in juxtaposition thereto. The bridge piece may have two or more ears extending laterally thereof whereby each bungy loop may be engaged with an ear to secure the apparatus in a non-releasable condition thereby rendering the release toggle inoperative.

The release toggle itself may comprise a length of semi-rigid bendable rod or plastics extrusion which can be led from the rescue apparatus to a position convenient to the helmsman or deck watch officer whereby in the event of man-overboard, the helmsman or watch officer grabs the release toggle and pulls on the same to withdraw the end thereof from the drillings in the bridge piece in the housing thereby releasing the bungy cord to allow the lifebelt to fall from the housing support under the influence of the motion of the vessel.

In this way automatic and substantially instantaneous release of the apparatus is achieved, and once the belt has been discharged from the housing support the line unwraps and the dan buoy is discharged in substantially automatic manner thus providing a clear indication of the transit along which the boat has to sail on its return journey in order to recover from man or object lost overboard.

Following is a description by way of example only and with reference to the accompanying drawings of an apparatus in accordance with the present invention.

Figure 1:
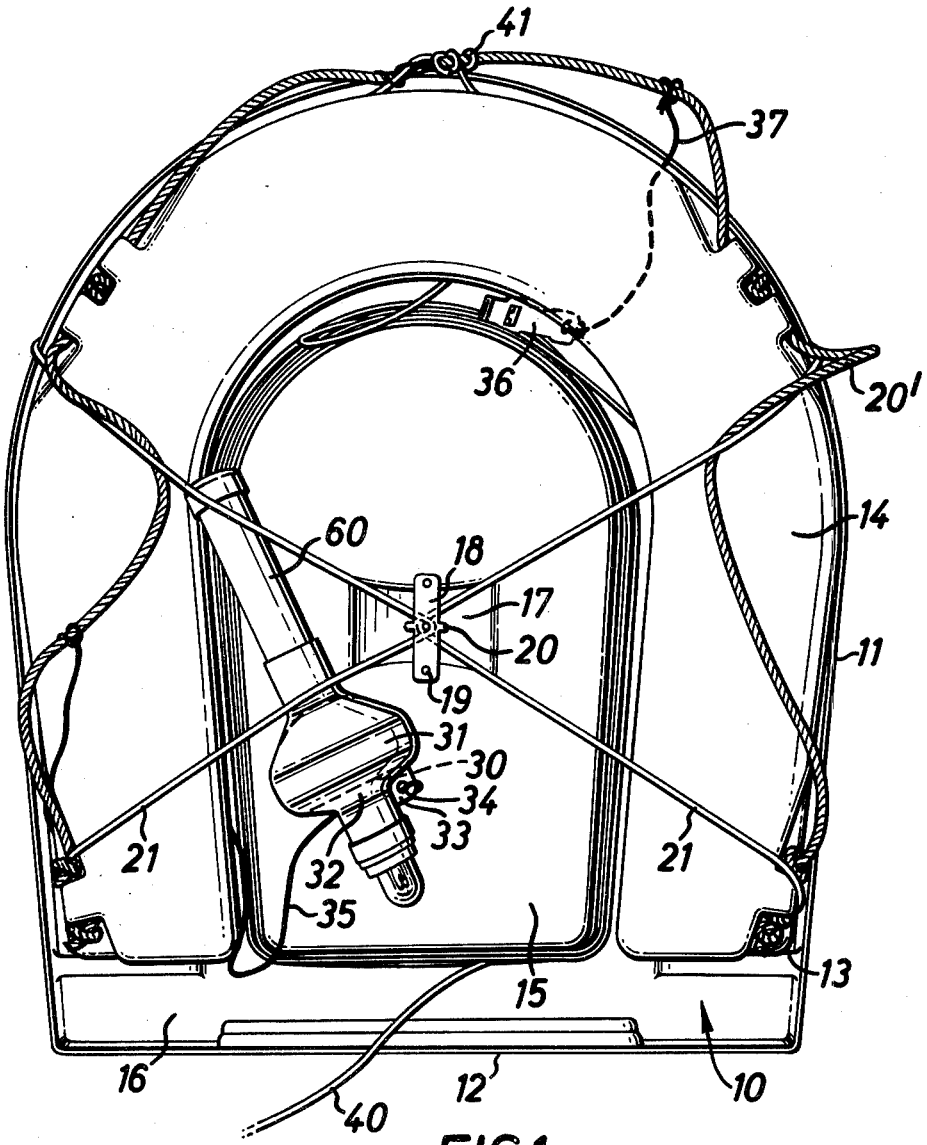
FIG. 1 is an elevation of the apparatus in its stowed position.

Referring now to FIG. 1, the apparatus comprises a housing support indicated generally at 10 having a generally horseshoe shaped side and upper periphery 11 and a substantially linear base edge 12. The housing support 10 is vacuum formed to provide a horseshoe recess 13 adapted to accommodate a horseshoe lifebuoy 14 and is provided with a central horseshoe shaped hub 15 and a transverse base recess 16 for the stowage of a small dan buoy, marker float or the like should this be deemed to be necessary. The horseshoe shaped hub 15 is provided with a central recess 17 having, in the operative position, substantially vertically disposed bridge piece 18 secured across recess 17 by means of plastic welds 19. The bridge piece 18 comprises a longitudinal strip of plastics material having a pair of laterally disposed ears 20.

The horseshoe lifebuoy 14 is of standard manufactured type, has a safety rope 20' secured to the outer periphery thereof.

The periphery of the housing support 10 is provided with four peripherally spaced drillings (not shown) for retaining bungy support retaining loops 21; one loop extending from spaced locations on each side of the unit.

The central hub is provided in a position offset from the central recess 17 with a shaped recess 30 adapted to accommodate the float portion 31 of a light buoy 32 so that with the bungy retaining cord in its retaining position, the cord extends across the lifebuoy 14 and across the light buoy 32 to retain both the lifebuoy and the light buoy in the stowed position. The light buoy is provided in a shoulder thereof with a flange 33 having a drilling 34 and is secured to the lifebuoy by means of line 35. The lifebuoy 14 may also include an attached whistle 36 secured thereto by means of line 37 attached to safety line 20.

Figure 3:
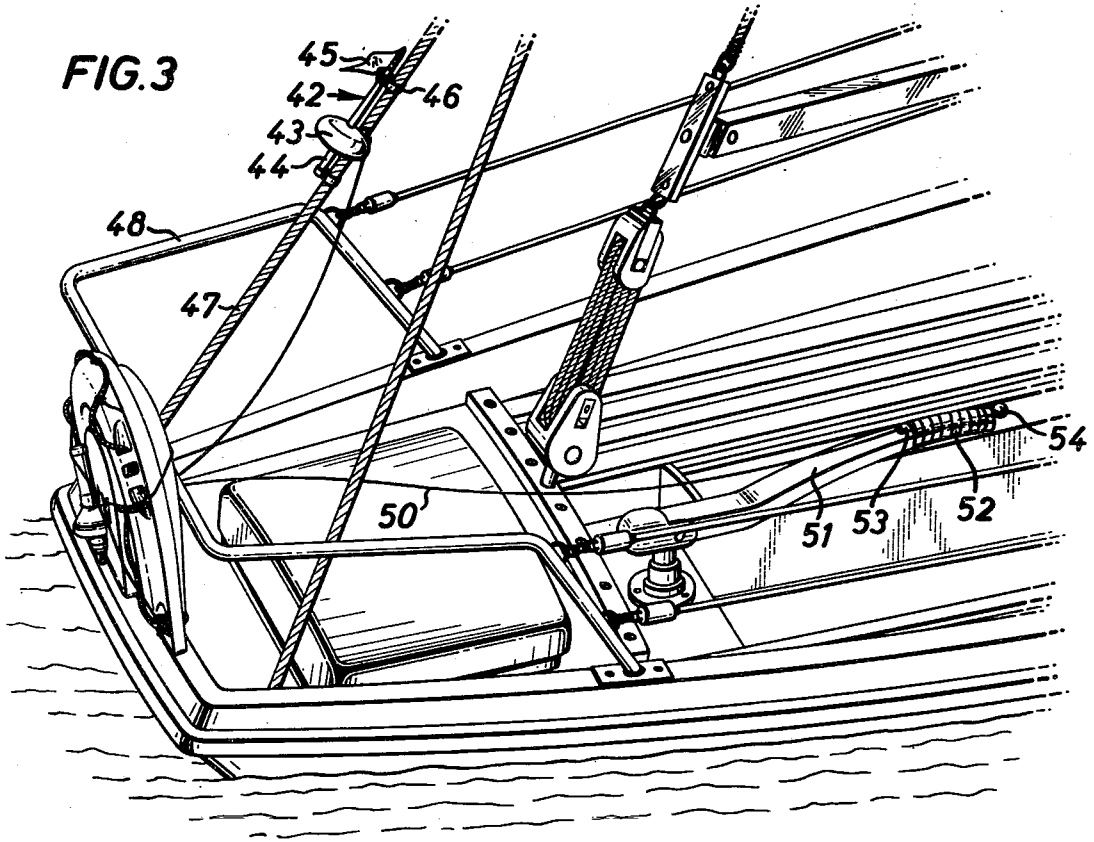
FIG. 3 is a perspective view of the aft end of a typical sailing vessel showing the apparatus in its operative position ready for use.

The central hub 15 of the housing support contains a plurality of wrapped buoyant line 40, one end 41 of which is secured to the safety rope 20' of lifebuoy 14. The other end is secured to a dan buoy 42 comprising a float 43 and a central rod 44 with a marker flag or pennant 45 at an upper end thereof. Such a dan buoy will normally be mounted in spring clips 46 secured to backstay 47 as shown in FIG. 3, or alternatively secured to a pulpit rail 48 at the aft end of the vessel.

The bridge piece has a central drilling (drilled hole) 49 and an aligned drilling in the recessed portion 17 of the housing support. The release toggle comprises a length of extruded bendable plastic 50 which is passed through the drilling 49 in the bridge piece, through the aligned drilling in the recess portion 17 and then passes across the aft deck of the vessel and may be retained or taped typically on to tiller 51 or the like, the tape portion 52 being disposed in a sleeve 53 and terminating at its end remote from the apparatus in a knob 54.

In its operative position, therefore, the bungy line 21 is passed beneath the bridge piece 18 between the bridge piece 18 and the surface of the recess 17 and the extrusion 50 is passed through the drilling to capture the loops 21 so that the inboard extremity of each of loops 21 bears against extrusion 50 and is retained in position thereby.

In a man overboard situation, the helmsman merely pulls on knob 54 to withdraw extrusion 50 forwardly of the vessel and to withdraw the end of extrusion 50 from the drilling 49 in bridge piece 18 thereby releasing the bungy loops 21 from their retaining position and allowing the light float 32 and the lifebuoy 14 to fall from the housing support and into the water. The forward movement of the vessel coupled with the drag of the buoy in the water unwraps the floating line from about the central hub until the extremity of line 40 has been discharged from the hub whereupon the drag is then applied to the dan buoy 42 which is dragged from its mounting and also into the water, (see FIG. 4).

Figures 2, 4:
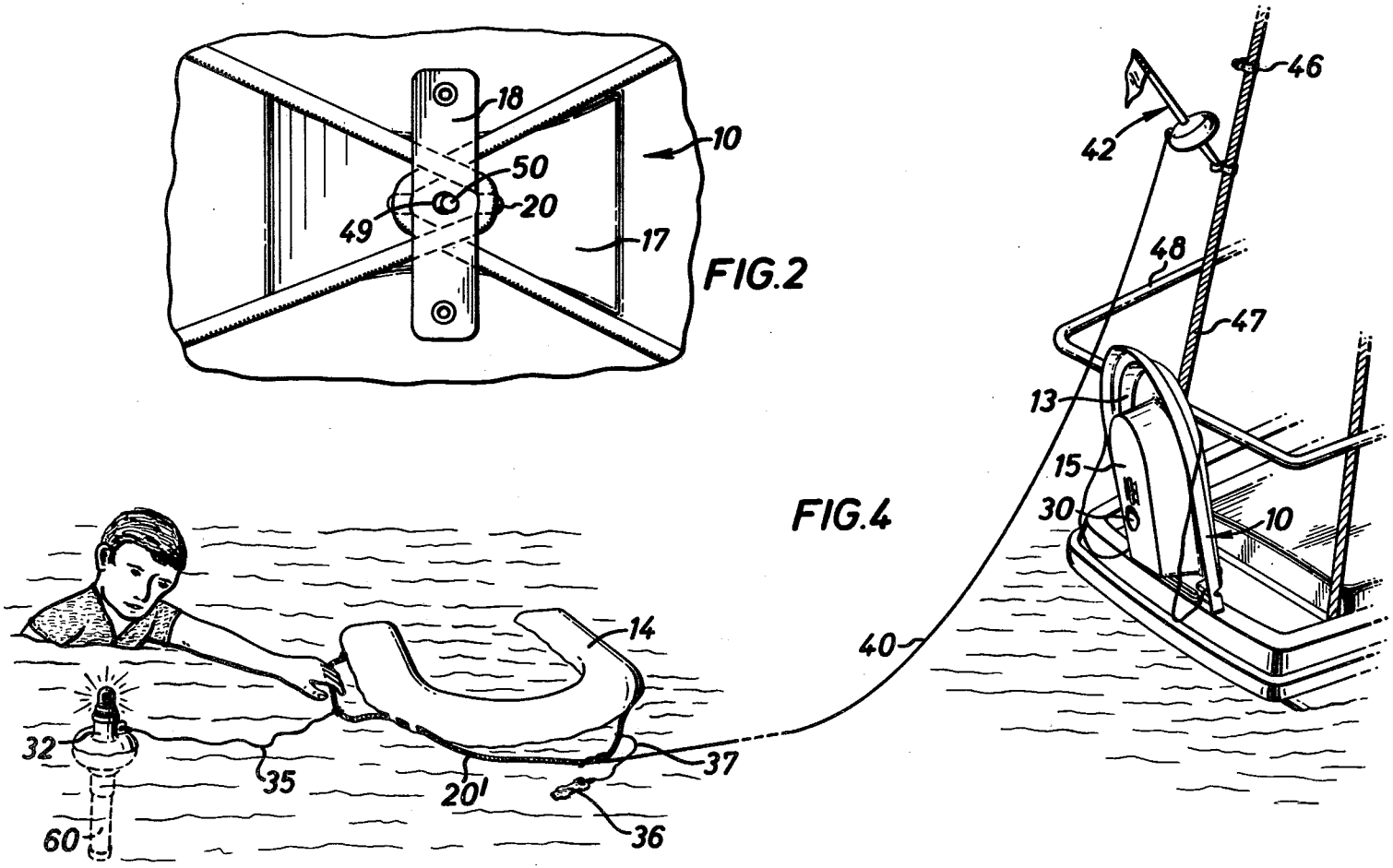
FIG. 2 is a detail of FIG. 1.
FIG. 4 shows the apparatus in use during the release sequence.

In order to prevent inadvertent release of the apparatus in a harbour situation a safety position is provided by means of ears 20; in the non-releasable condition, the loops of bungy 21 are merely engaged with ears 20 in the manner shown in FIG. 2 so they no longer bear against the withdrawable extrusion 50 thus placing the apparatus in a secured attitude.

In order to secure the McMurdo or other light float against heavy weather use, an additional security clip may be provided for engagement of the battery housing 60 of the light float thereby additionally securing the light float to the housing support.

It will be appreciated that the apparatus described above provides a facile and rapid means of discharging life saving equipment into the water in a man-overboard or like situation. The presence of the light float and the dan buoy at a distance spacing of the order of 200 feet, i.e. the extremity of the buoyant line 40, provides an adequate transit for the crew of the vessel to return along their original course line to recover the man in the water. The time delay, therefore, between recognising a man overboard situation and implementing the discharge of the rescue equipment is reduced to an absolute minimum since the release means i.e. knob 54 is close to hand for the helmsman.

It will be appreciated that in a vessel with wheel steering, the release knob 54 would be provided in a position juxtaposed the steering position.

I claim:

1. Rescue apparatus, comprising:

a lifebelt; a housing having a recess shaped for accommodating said lifebelt and said lifebelt being accommodated in said housing recess; said recess being open topped to permit said lifebelt to exit from said housing; said recess defining and at least partially surrounding a hub of said housing;

a length of line secured to said lifebelt and wrapped about said hub; marker means attached to said line at a distance along said line from the attachment of said line to said lifebelt;

retaining means for retaining said lifebelt in juxtaposition to said housing and in said recess; said retaining means comprising at least one elastic retaining member extending generally from the periphery of said housing past and over said lifebelt and to said hub;

release means for releasing said retaining means to permit said lifebelt to exit from said housing and as said lifebelt is drawn away from said housing, said lifebelt draws said line along and off said hub until said marker means is also drawn away from said housing; said release means comprising a removable element on said hub and removably holding said elastic retaining member and being removable from said retaining member for freeing said lifebelt for exiting said housing;

said release means including an operator remote from said retaining means and also connected with said removable element, whereby said lifebelt may be released by acting on said operator remote from said lifebelt.

2. Apparatus as claimed in claim 1 wherein said lifebelt is attached to a light adapted to flash on release of said retaining means.

3. Apparatus as claimed in claim 1 wherein said marker means is a dan buoy.

4. Apparatus as claimed in claim 1, wherein said line is a buoyant line.

5. Apparatus as claimed in claim 1, wherein said release means comprises a recess in said housing at said hub; a bridge portion overlaying said recess; a drilling in said bridge portion and recess; a release toggle including a length of rod extending through said drilling in said recess of said housing and said bridge piece;

said retaining means comprising at least one loop of bungy line extending generally from the periphery of said housing past and over said lifebelt, and said loop being passed between said bridge piece and said recess; said loop being secured by means of said toggle passing between said recess and said bridge piece for retaining said bungy line across said housing to hold said lifebelt in juxtaposition to said housing; said release toggle rod being removable from said drilling for releasing said lifebelt from said housing.

6. Apparatus as claimed in claim 5, wherein said release toggle rod is a semi-rigid, bendable element.

7. Apparatus as claimed in claim 5, wherein there are a plurality of said loops of bungy line, each extending from a respective spaced apart location generally from the periphery of said housing past and over said lifebelt to said hub.

8. Apparatus as claimed in claim 7 wherein said bridge portion has at least two ears and each said bungy loop being engageable with a said ear and thereby lifting each said loop off said toggle, thereby to secure the apparatus in a non-releasable condition, thereby rendering said release toggle inoperative.

9. Rescue apparatus comprising:

a lifebelt, a housing support for said lifebelt, said housing support being adapted to be mounted in a substantially erect manner, releasable retaining means for retaining said lifebelt in juxtaposition to said housing support, said retaining means comprising at least one retaining member extending from said periphery of said housing support to maintain the lifebelt in its stowed position, release means supported by said housing and comprising a central recessed portion of said housing support, a bridge piece overlaying said recessed portion, a drilling in said bridge portion and said recessed portion, a release toggle including a length of semi-rigid bendable rod extending through said drilling in said recessed portion of said housing and in said bridge piece, each said retaining member comprises at least one loop of bungee line extending from spaced locations toward said periphery of said housing support to said rod whereby in the retaining attitude, said loop is passed between said bridge piece and said recessed portion and is secured by means of said toggle passing between said recessed portion and said bridge piece to retain said bungee line across said housing support to hold said lifebelt in juxtaposition thereto and, whereby the removal of said toggle rod releases each said retaining member to allow said lifebelt to fall from said housing support.

10. Apparatus as claimed in claim 9, wherein each said retaining member is elastic and is tensioned as it engages said rod, whereby removal of said rod releases each said elastic retaining member to release its tension and allow said lifebelt to fall from said housing support.

11. Apparatus as claimed in claim 9, wherein said bridge piece has at least two ears thereon, whereby each said bungee loop can be engaged with a said ear to secure the apparatus in a non-releasable condition, thereby rendering said release toggle inoperative.

12. Apparatus as claimed in claim 9, wherein said housing support is recessed to accommodate said lifebelt and wherein said recess defines a central hub, a length of buoyant line being secured to said lifebelt and said line being wrapped about said central hub, whereby on release of said lifebelt, said buoyant line unwraps progressively from said hub;

marker means secured to said buoyant line, the arrangement being such that the release of said lifebelt from a moving vessel progressively withdraws said buoyant line from its said hub until said length has run out and said marker means is also released to provide a transit in the water for the vessel to return to.

13. Apparatus as claimed in claim 12, wherein said marker means is a dan-buoy, a light attached to said lifebelt which flashes on release of said lifebelt from said housing support.

* * * * *